US007477270B2

(12) United States Patent
Hector et al.

(10) Patent No.: US 7,477,270 B2
(45) **Date of Patent: *Jan. 13, 2009**

(54) ACTIVE MATRIX DISPLAY DEVICE

(75) Inventors: Jason R. Hector, Redhill (GB); Neil C. Bird, Horsham (GB)

(73) Assignee: TPO Hong Kong Holding Limited, Shatin, Hong Kong SAR (CN)

( * ) Notice: Subject to any disclaimer, the term of this patent is extended or adjusted under 35 U.S.C. 154(b) by 601 days.

This patent is subject to a terminal disclaimer.

(21) Appl. No.: 10/850,950

(22) Filed: May 21, 2004

(65) Prior Publication Data

US 2004/0233151 A1 Nov. 25, 2004

Related U.S. Application Data

(63) Continuation of application No. 10/072,117, filed on Feb. 8, 2002, now Pat. No. 6,756,961.

(30) Foreign Application Priority Data

Mar. 2, 2001 (GB) ..... 0105148.1

(51) Int. Cl.
*G09G 5/10* (2006.01)

(52) U.S. Cl. ..... 345/690; 345/100

(58) Field of Classification Search ..... 345/76, 345/77, 80, 87–89, 98–100, 204–206, 690
See application file for complete search history.

(56) References Cited

U.S. PATENT DOCUMENTS

| | | | | |
|---|---|---|---|---|
| 5,130,829 | A | 7/1992 | Shannon | 359/59 |
| 5,337,070 | A | 8/1994 | Kitajima et al. | |
| 5,399,992 | A * | 3/1995 | Itakura et al. | 330/257 |
| 5,574,475 | A | 11/1996 | Callahan, Jr. et al. | |
| 6,008,801 | A * | 12/1999 | Jeong | 345/204 |
| 6,040,816 | A * | 3/2000 | Uchino | 345/99 |
| 6,111,557 | A * | 8/2000 | Koyama et al. | 345/89 |
| 6,157,360 | A * | 12/2000 | Jeong et al. | 345/98 |
| 6,166,725 | A * | 12/2000 | Isami et al. | 345/209 |
| 6,232,946 | B1 * | 5/2001 | Brownlow et al. | 345/98 |
| 6,373,459 | B1 * | 4/2002 | Jeong | 345/100 |
| 6,396,470 | B1 * | 5/2002 | Zhang et al. | 345/87 |
| 6,437,768 | B1 * | 8/2002 | Kubota et al. | 345/100 |

(Continued)

FOREIGN PATENT DOCUMENTS

| | | |
|---|---|---|
| GB | 2300773 | 11/1996 |

(Continued)

*Primary Examiner*—Richard Hjerpe
*Assistant Examiner*—Tom V Sheng
(74) *Attorney, Agent, or Firm*—Liu & Liu

(57) ABSTRACT

A display has circuitry (50) which generates all possible pixel drive signal levels on separate signal level lines. A buffer (54) is associated with each signal level line. The outputs of the buffers are selectably switchable onto the columns. The signal levels for each column are stored in a memory (72) and the buffers are controlled in dependence on the stored signal levels. The response of the buffers is heavily dependent on the output load, and there is a very large variation in the output load of the buffers (54), as a function of the number of columns to which the buffer output is to be provided. The buffers are controlled in dependence on stored signal levels to ensure stability of the buffers for any output load.

9 Claims, 6 Drawing Sheets

U.S. PATENT DOCUMENTS

| | | | | |
|---|---|---|---|---|
| 6,504,522 | B2 * | 1/2003 | Shiraki et al. | 345/98 |
| 6,756,961 | B2 * | 6/2004 | Hector et al. | 345/98 |
| 2002/0005862 | A1 * | 1/2002 | Deering | 345/694 |
| 2003/0085854 | A1 * | 5/2003 | Tsuji | 345/82 |

FOREIGN PATENT DOCUMENTS

| | | | |
|---|---|---|---|
| GB | 2325329 | | 11/1998 |
| JP | 05040451 | A * | 2/1993 |
| WO | 9809269 | | 3/1998 |
| WO | WO99 52012 | | 10/1999 |

* cited by examiner

ACTIVE MATRIX DISPLAY DEVICE

This application is a continuation of Ser. No. 10/072,117, filed Feb. 8, 2002, now U.S. Pat. No. 6,756,961.

This invention relates to active matrix display devices, and relates in particular to the circuitry used for providing drive signals to the pixels of the display.

Active matrix display devices typically comprise an array of pixels arranged in rows and columns. Each row of pixels shares a row conductor which connects to the gates of the thin film transistors of the pixels in the row. Each column of pixels shares a column conductor, to which pixel drive signals are provided. The signal on the row conductor determines whether the transistor is turned on or off, and when the transistor is turned on, by a high voltage pulse on the row conductor, a signal from the column conductor is allowed to pass on to an area of liquid crystal material, thereby altering the light transmission characteristics of the material. An additional storage capacitor may be provided as part of the pixel configuration to enable a voltage to be maintained on the liquid crystal material even after removal of the row electrode pulse. U.S. Pat. No. 5,130,829 discloses in more detail the design of an active matrix display device.

The frame (field) period for active matrix display devices requires a row of pixels to be addressed in a short period of time, and this in turn imposes a requirement on the current driving capabilities of the transistor in order to charge or discharge the liquid crystal material to the desired voltage level. In order to meet these current requirements, the gate voltage supplied to the thin film transistor needs to fluctuate between values separated by approximately 30 volts. For example, the transistor may be turned off by applying a gate voltage of around −10 volts, or even lower, (with respect to the source) whereas a voltage of around 20 volts, or even higher, may be required to bias the transistor sufficiently to provide the required source-drain current to charge or discharge the liquid crystal material sufficiently rapidly.

The requirement for large voltage swings in the row conductors requires the row driver circuitry to be implemented using high voltage components.

The voltages provided on the column conductors typically vary by approximately 10 volts, which represents the difference between the drive signals required to drive the liquid crystal material between white and black states. Various drive schemes have been proposed enabling the voltage swing on the column conductors to be reduced, so that lower voltage components may be used in the column driver circuitry. In the so-called "common electrode drive scheme", the common electrode, connected to the full liquid crystal material layer, is driven to an oscillating voltage. The so-called "four-level drive scheme" uses more complicated row electrode waveforms in order to reduce the voltage swing on the column conductors, using capacitive coupling effects.

These drive schemes enable lower voltage components to be used for the column driver circuitry. However, there is still a significant amount of complexity and power inefficiency in the column driver circuits. Each row is addressed in turn, and during the row address period of any one row, pixel signals are provided to each column. In the past, each column would be provided with a buffer for holding a pixel in the column to a drive signal level for the full duration of the row address period. This large number of buffers results in high power consumption.

There have been proposals to provide a multiplexing scheme, in which a buffer is shared between a group of columns. The output of the buffer is switched in turn to the columns of the group. When the buffer is providing a signal to one column, it is isolated from the other columns by a switch. Multiplexing is possible because the line time of the display is significantly greater than the time required to charge a column to the required voltage. In small displays for mobile applications, the line time may be in excess of 150 μs whereas the time required to charge a column is typically less than 10 μs.

Once the column has been charged to the required voltage, and after the end of the application of the required voltage to the column, charge transfer takes place between the charged column capacitance and the pixel capacitance. The column capacitance may be around 30 times larger than the column capacitance, so that the charge transfer to the pixel results in only a small voltage change. However, this charge transfer enables the pixel to be charged using a short column address pulse, despite the longer time constant of the pixel (resulting from the high TFT resistance).

A problem with this multiplexing approach is that there is cross talk between the columns within the group, particularly as all but one of the columns of the group are effectively floating at any point in time, and are therefore susceptible to signal level fluctuations. During the row address period, the TFTs of all pixels in the row are switched on (and indeed this enables the charge transfer to take place between the column capacitance and the pixel), so that any signal fluctuations on the column conductors as a result of cross talk are passed onto the pixels.

The invention provides an alternative approach for reducing the number of buffers required by the column driver circuitry.

According to a first aspect of the invention, there is provided a display device comprising an array of liquid crystal pixels arranged in rows and columns, wherein each column of pixels shares a column conductor to which pixel drive signals are provided, wherein column address circuitry is provided for generating the pixel drive signals, the column address circuitry comprising circuitry for generating all possible drive signal levels on separate signal level lines and a buffer associated with each signal level line, the outputs of the buffers being selectably switchable onto the columns, wherein the column address circuitry further comprises a memory for storing the signal levels to be provided to each column, and wherein the buffers are controlled in dependence on the stored signal levels.

The invention provides an alternative approach by which a grey level generation circuit is provided with a buffer for each possible grey level output. The response of the buffers is heavily dependent on the output load, and such buffers are typically designed to be suitable for specific ranges of output loads. As a result of the large number columns in a display, there is a very large variation in the output load of the buffers, as a function of the number of columns to which the buffer output is to be provided. Therefore, the buffers are controlled in dependence on stored signal levels to ensure stability of the buffers for any output load.

In one example, a bias current to each buffer is controlled in dependence on the number of columns to which the buffer output is to be switched.

In another example, each signal level line is associated with a plurality of buffers, each of the plurality of buffers being suitable for different output loads, wherein one of the plurality of buffers is selected in dependence on the number of columns to which the buffer output is to be switched. Each signal level line may be associated with two buffers.

In another example, each buffer has a plurality of output stages, and wherein the number of output stages used is controlled in dependence on the number of columns to which the buffer output is to be switched.

In a further example, an additional buffer is provided and the additional buffer is used when the number of columns to which an individual buffer output is to be switched exceeds half the total number of columns.

These examples each provide arrangements which enable the output load required of each buffer to be used to provide control of the buffer configuration, in order to ensure stability of the buffer arrangements. The number of grey levels will typically be much smaller than the number of columns, so that the arrangement of the invention reduces the number of buffers required.

Preferably, each pixel comprises a thin film transistor switching device and a liquid crystal cell, wherein each row of pixels share a row conductor which connects to the gates of the thin film transistors of the pixels in the row, and wherein row driver circuitry provides row address signals for controlling the switching of the transistors of the pixels of the row.

According to a second aspect of the invention, there is provided a method of providing pixel drive signals to a display device comprising an array of liquid crystal pixels arranged in rows and columns, the method comprising:

generating all possible pixel drive signal levels;

providing each pixel drive signal level to an associated buffer;

storing the required pixel drive signals for a row of pixels in a memory;

calculating the required number of pixels of the row to be addressed by each drive signal;

controlling the buffers in dependence on the calculated number of pixels; and switching the buffer outputs onto the columns during the row address period for the row to be addressed.

The step of controlling the buffers may comprise applying an appropriate bias current to the buffers, selecting between alternative buffers for each pixel drive signal level or selecting a number of output stages to be connected to each buffer.

The invention also provides column address circuitry for driving the columns of a liquid crystal display, comprising circuitry for generating all possible drive signal levels on separate signal level lines and a buffer associated with each signal level line, the outputs of the buffers being selectably switchable onto the column outputs, wherein the column address circuitry further comprises a memory for storing the signal levels to be provided to each column, and wherein the buffers are controlled in dependence on the stored signal levels.

Examples of the invention will now be described in detail with reference to the accompanying drawings, in which.

Figure 1:
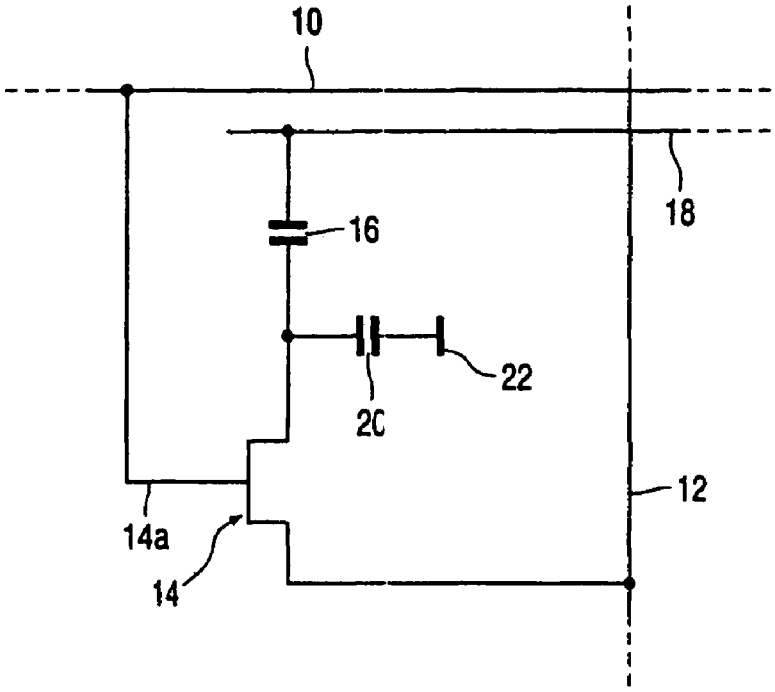
FIG. 1 (PRIOR ART)
FIG. 1 shows one example of a known pixel configuration for an active matrix liquid crystal display.

FIG. 1 shows a conventional pixel configuration for an active matrix liquid crystal display. The display is arranged as an array of pixels in rows and columns. Each row of pixels shares a common row conductor 10, and each column of pixels shares a common column conductor 12. Each pixel comprises a thin film transistor 14 and a liquid crystal cell 16 arranged in series between the column conductor 12 and a common potential 18. The transistor 14 is switched on and off by a signal provided on the row conductor 10. The row conductor 10 is thus connected to the gate 14*a* of each transistor 14 of the associated row of pixels. Each pixel may additionally comprise a storage capacitor 20 which is connected at one end 22 to the next row electrode, to the preceding row electrode, or to a separate capacitor electrode. This capacitor 20 helps to maintain the drive voltage across the liquid crystal cell 16 after the transistor 14 has been turned off. A higher total pixel capacitance is also desirable to reduce various effects, such as kickback, and to reduce the grey-level dependence of the pixel capacitance.

In order to drive the liquid crystal cell 16 to a desired voltage to obtain a required grey level, an appropriate signal is provided on the column conductor 12 in synchronism with a row address pulse on the row conductor 10. This row address pulse turns on the thin film transistor 14, thereby allowing the column conductor 12 to charge the liquid crystal cell 16 to the desired voltage, and also to charge the storage capacitor 20 to the same voltage.

At the end of the row address pulse, the transistor 14 is turned off. The storage capacitor 20 reduces the effect of liquid crystal leakage and reduces the percentage variation in the pixel capacitance caused by the voltage dependency of the liquid crystal cell capacitance. The rows are addressed sequentially so that all rows are addressed in one frame period, and refreshed in subsequent frame periods.

Figure 2:
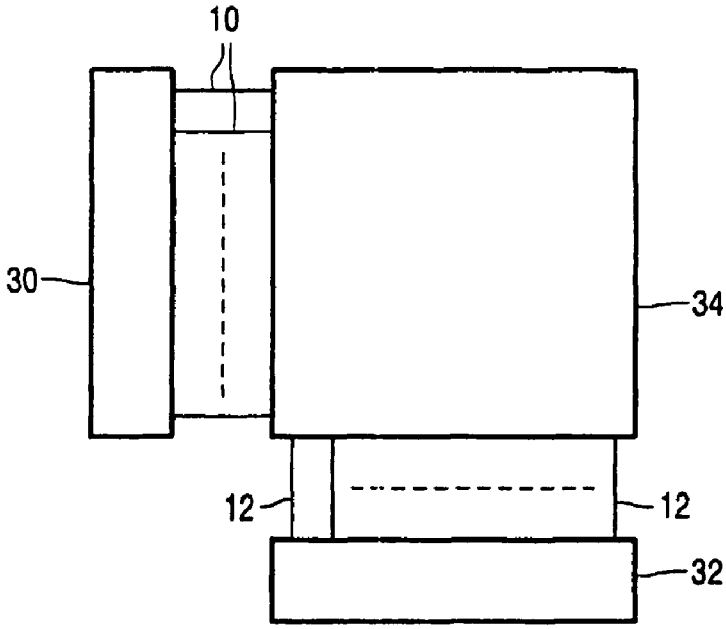
FIG. 2 (PRIOR ART)
FIG. 2 shows a display device including row and column driver circuitry.

As shown in FIG. 2, the row address signals are provided by row driver circuitry 30, and the pixel drive signals are provided by column address circuitry 32, to the array 34 of display pixels.

In order to enable a sufficient current to be driven through the thin film transistor 14, which is implemented as an amorphous silicon thin film device, a high gate voltage must be used. In particular, the period during which the transistor is turned on is approximately equal to the total frame period within which the display must be refreshed, divided by the number of rows. It is well known that the gate voltage for the on-state and the off-state differ by approximately 30 volts in order to provide the required small leakage current in the off-state, and sufficient current flow in the on-state to charge or discharge the liquid crystal cell 16 within the available time. As a result, the row driver circuitry 30 uses high voltage components.

There are various known addressing schemes for driving the display of FIG. 1, and these will not be described in detail in this text. Some of the known operational techniques are described in greater detail, for example in U.S. Pat. No. 5,130,829 and WO 99/52012, and these documents are incorporated herein by way of reference material. The invention is applicable to any particular drive scheme, and for this reason, no further explanation will be given of the precise operation of any particular drive scheme. This will be well known to those skilled in the art.

Figure 3:
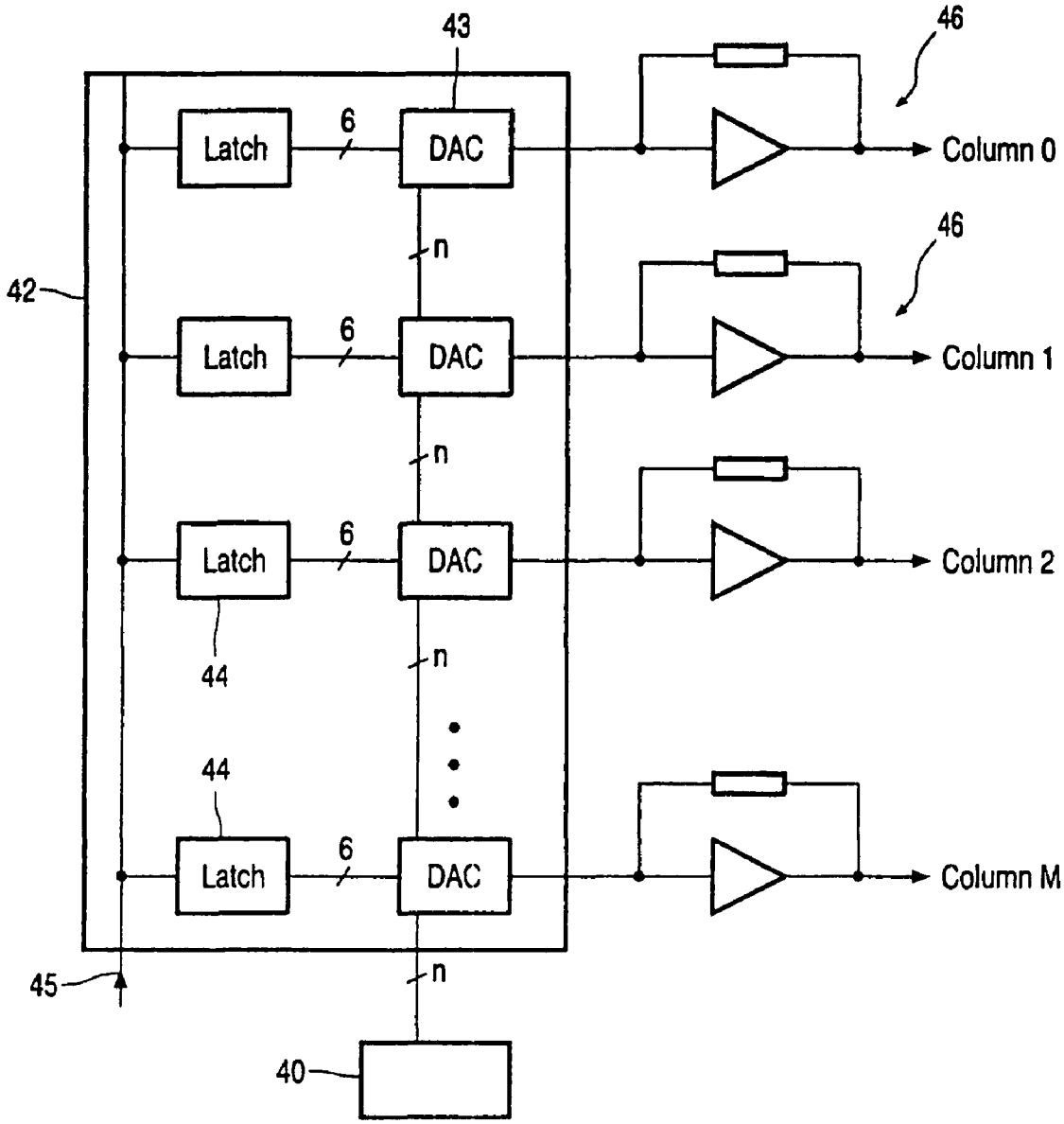
FIG. 3 (PRIOR ART)
FIG. 3 shows a conventional column driver circuit.

FIG. 3 shows a conventional column driver circuit. The number n of different pixel drive signal levels are generated by a grey level generator 40, for example a resistor array. A switching matrix 42 controls the switching of the required level to each column and comprises an array of converters 43 for selecting one of the n grey levels based on a digital input from a latch 44. The digital input is derived from a RAM storing the required image data 45. Each column is provided with a buffer 46 for holding a pixel in the column to the required drive signal level for the full duration of the row address period. This large number of buffers 46 results in high power consumption.

Figure 4:
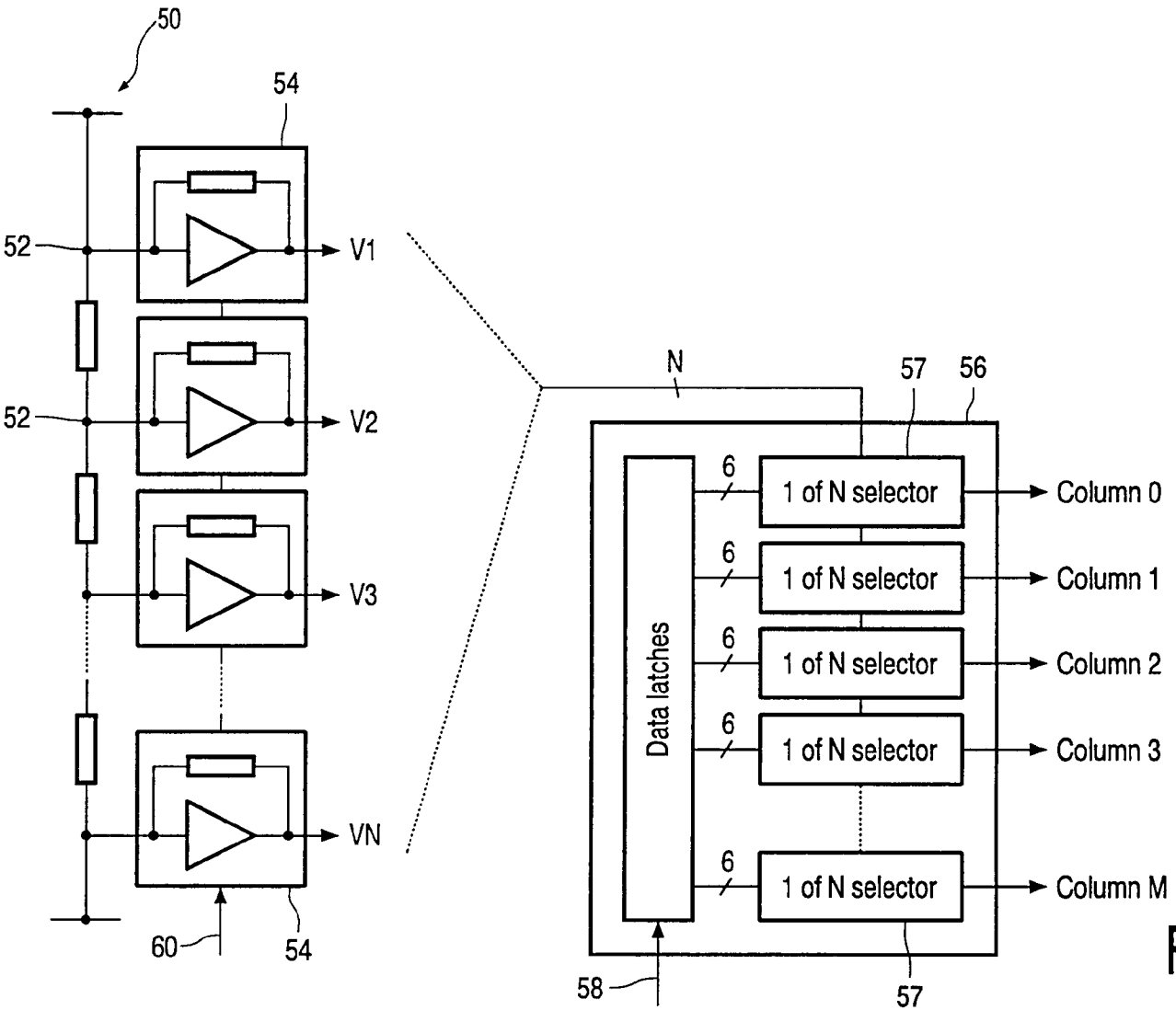
FIG. 4 shows a column driver circuit according to the invention.

To reduce power in a low power chipset to drive the active matrix LCD, the total number of buffers needs to be reduced. This also enables less area to be occupied. In accordance with the invention, the grey level voltages are generated and then switched through an associated buffer to the relevant column, as shown in FIG. 4.

The grey level generation circuit 50 comprises a resistor array between maximum and minimum voltages, with each tap 52 being provided to an associated buffer 54. There are N buffers in total, providing the N grey scale levels. The N signal levels are provided to a switching matrix 56 which enables one of the N levels to be switched to each column, based on the image data 58 provided from a RAM. Each column is associated with a 1 of N selector 57. In the example of FIG. 4, the required pixel data is defined by a six bit word, giving a total number of grey scale levels, N, of 64.

The number of columns that any one buffer 54 is driving will depend on the number of pixels in the addressed row which have the same pixel data. This means that each buffer has a possible maximum to minimum load ratio of 500 to 1 for a display with 500 columns. This load range is too large and results in unstable or extremely large buffers. To overcome this, the invention provides an architecture by which the number of columns is known, and hence the load seen by each buffer can be determined.

A histogram is constructed in RAM of the pixel data for the row. This enables the number of columns each buffer will be driving to be determined, and therefore enables the load to be calculated. The buffers are then controlled in dependence on the stored pixel data, as represented schematically by arrow 60 in FIG. 4, which represents the RAM histogram data.

Figure 5:
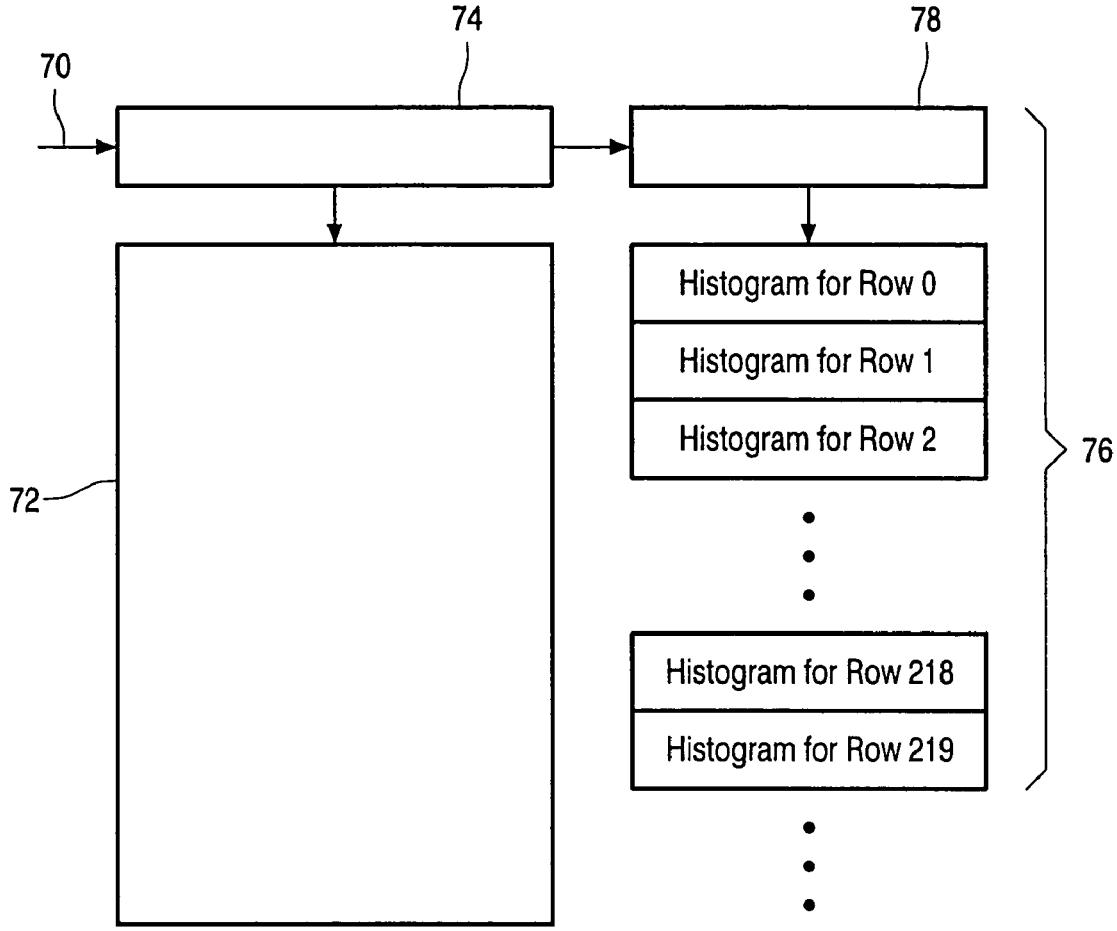
FIG. 5 shows in greater detail the memory in the circuit of FIG. 4.
Figure 6:
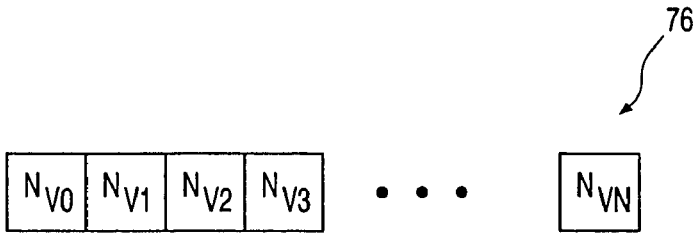
FIG. 6 shows in greater detail part of the memory of FIG. 5.

FIG. 5 shows the architecture of the RAM for storage of the histogram data. In conventional manner, image data is received from a host at the input 70. This is written into an image data storage section 72 of the memory using a line store 74. The invention can be implemented using an additional area of RAM 76, which is reserved for storing the histogram data for each row in the image. The histogram data is obtained using counters 78. The organisation of the histogram part 76 of the memory for one row is shown in detail in FIG. 6. The number of pixels in a row having each of the N signal levels V1, V2 . . . VN, is stored, as number $N_{VN}$.

Image data is written from the host to the area 72 of the RAM and is then piped from the area 72 to the column driver switching matrix 56, whenever the latter needs to be refreshed. During the period when data is being written to the area 72 of RAM via the line store 74, the series of counters 78 build up the histogram data and, when all of the row data has arrived, stores the histogram at the appropriate location 76 in the RAM. In this way, the histogram only needs to be calculated once when the data arrives. The alternative is to calculate the histogram data when it is being read out from the RAM as the display is being updated. However, in this latter case the histograms will be calculated up to frame rate times per second for each row and this will cost power.

There are various ways to use this histogram data to control the configuration of the buffers, so that the buffers are stable at the required output load.

Figure 7:
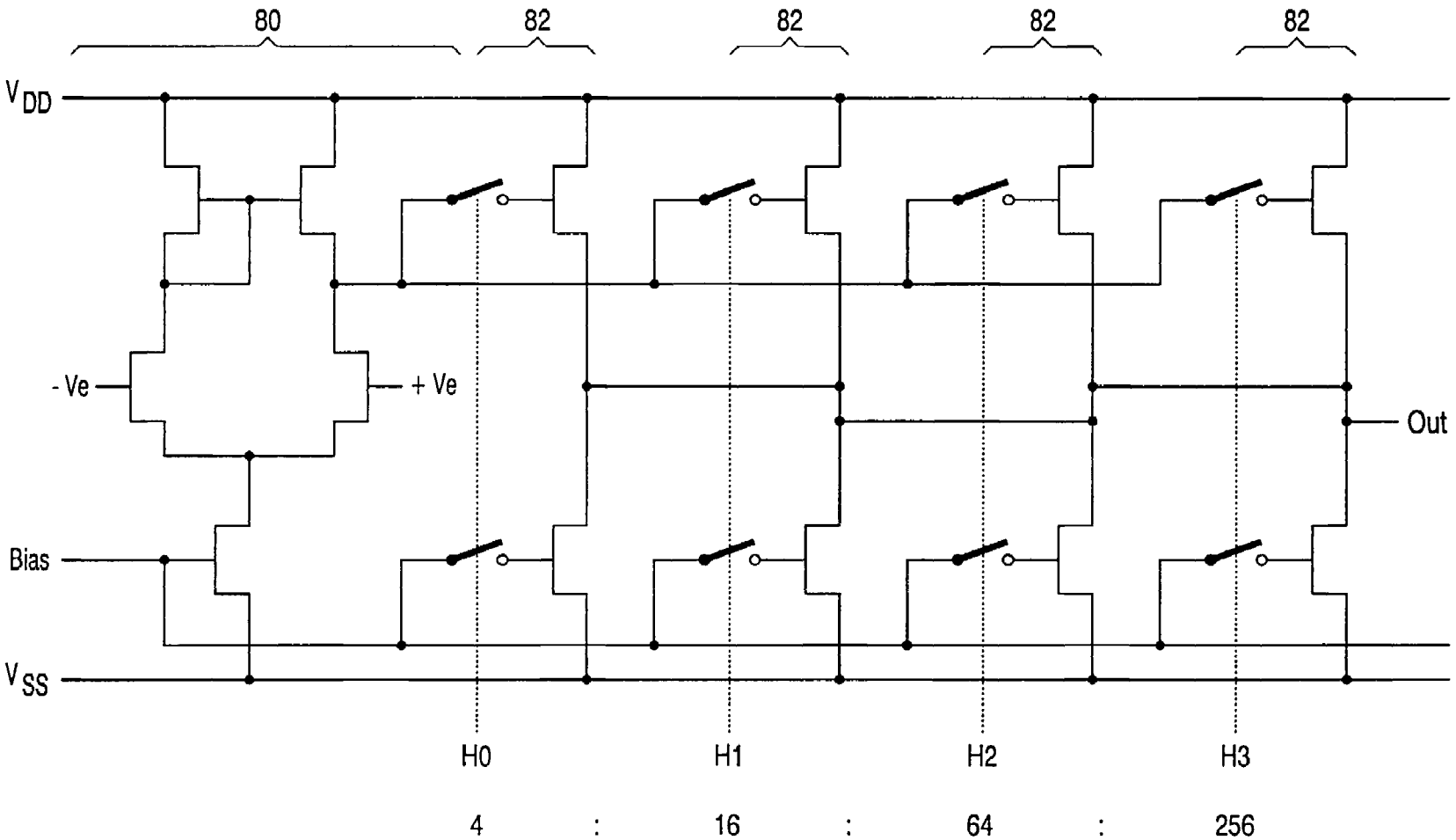
FIG. 7 shows one buffer configuration for use in the column driver circuit of the invention.

FIG. 7 shows a first example in which the histogram data is used to vary the capacitive drive capability of simple 2-stage amplifier. A conventional 2-stage circuit 80 is extended by adding extra output stages 82 in parallel. These additional output stages 82 are enabled under control from the histogram information (Ho, H1, H2 and H3). Thus, a number of output stages can be switched into operation as a function of the required output load. This enables a low power consumption to be maintained when there is low output demand, but enables a high output demand to be tolerated by increasing the currents flowing through the buffer. In this way, the second stage can be controlled to match the load capacitance, thereby giving similar settling characteristics for the different loads. For example, the output impedance, slew rate and stability margin can be controlled by switching in selected output stages. In the illustrated circuit, the "resolution" of the output stage switching is four columns, so that each configuration of the amplifier needs to be capable of driving a capacitive load that varies from a lowest value to a highest value a factor of 4 greater than the lowest value. In the example shown, one output configuration is for 1 to 4 columns, the next configuration is for 5 to 16 columns, and so on. This method of adjusting the output stages of the amplifier effectively adjusts the output impedance of the buffer to maintain stability for the required output load. Unused buffers can be powered down, again to reduce the total power.

There are of course other schemes for varying the buffer configuration in dependence on the desired output load. For example, the buffers may have a bias current input. The bias current may then be altered as a function of the output load, to provide the desired matching. Alternatively, the buffer may be provided with a buffer loading capacitor. As the output load is increased, the buffer loading capacitor can be switched out of circuit, so that the overall load capacitance (the buffer loading capacitance and the output load capacitance) remains fairly constant.

Figure 8:
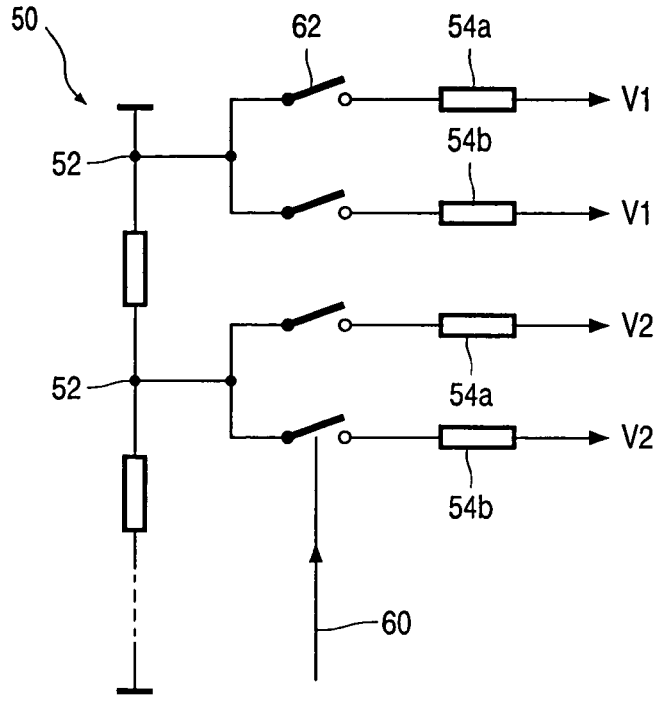
FIG. 8 shows another buffer configuration for use in the column driver circuit of the invention.

FIG. 8 shows an arrangement in which each signal level line is associated with two buffers 54*a* and 54*b*. Each of the two of buffers is suitable for different output loads. One of the two buffers is selected in dependence on the number of columns to which the buffer output is to be switched. Thus, the histogram data at input 60 controls switches 62 arranged in complementary pairs. This enables the maximum output load variation to be halved. Each signal level line may of course be associated with a greater number of buffers.

Figure 9:
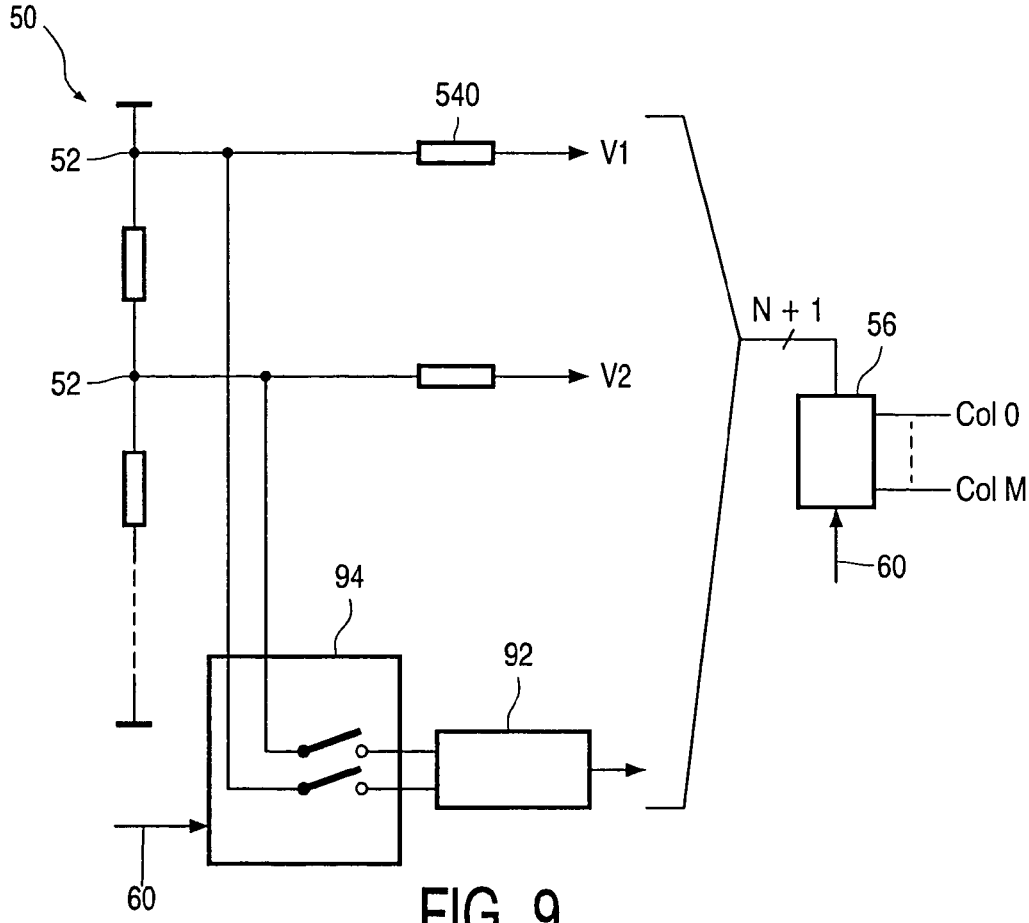
FIG. 9 shows a further buffer configuration for use in the column driver circuit of the invention.

In the example of FIG. 9, an additional buffer 92 is provided and the additional buffer 92 is used when the number of columns to which an individual buffer output is to be switched exceeds half the total number of columns. Thus, if buffer 540 in FIG. 9 is to supply more than half the pixels of a row (as determined from the histogram data 60), a switching matrix 94 routes the corresponding signal level V1 from the grey level generator 50 to the additional buffer 92. The output of buffer 92 is used to drive some columns whereas the output of buffer 540 is used to drive others. The switching matrix 56 then receives N+1 signal levels, and the histogram data 60 is used to control the switching matrix 56 so that when one signal level is required for more than half of the pixels of the row, this load is shared between the buffer for that signal level and the additional buffer.

There may be two or more additional buffers, which enables the required output load range of the individual buffers to be reduced further.

The terms "row" and "column" are somewhat arbitrary in the description and claims. These terms are intended to clarify that there is an array of elements with orthogonal lines of elements sharing common connections. Although a row is normally considered to run from side to side of a display and a column to run from top to bottom, the use of these terms is not intended to be limiting in this respect.

The column circuit may be implemented as an integrated circuit, and the invention also relates to the column circuits for implementing the display architecture described above.

Other features of the invention will be apparent to those skilled in the art.

The invention claimed is:

1. A display device comprising:

an array of liquid crystal pixels arranged in rows and columns, wherein:

each column of pixels includes a column conductor to which pixel drive signals are provided to pixels in the column, a column address circuitry is provided for generating the pixel drive signals, the column address circuitry comprising:

circuitry for generating all defined drive signal levels on corresponding separate signal level lines, and a buffer associated with each signal level line, the outputs of the buffers being selectably switchable onto the columns as the pixel drive signals, and a memory storing values corresponding to the drive signal levels to be provided to each column, wherein each signal level line is associated with a plurality of buffers, each of the plurality of buffers being suitable for different output loads, and one of the plurality of buffers is selected in dependence on a quantity of columns to which the buffer output is to be switched.

2. A display device as claimed in claim 1, wherein each signal level line is associated with two buffers.

3. A display device as claimed in claim 1, wherein:

each buffer has a plurality of selectable output stage, and the output stages selected is controlled in dependence on a quantity of columns to which the buffer output is to be switched.

4. A display device as claimed in claim 1, wherein:

each pixel comprises a thin film transistor switching device and a liquid crystal cell, each row of pixels includes a row conductor which connects to the gates of the thin film transistors of the pixels in the row, and row driver circuitry provides row address signals for controlling switching of the transistors of the pixels of the row.

5. A method of providing pixel drive signals to a display device comprising an array of liquid crystal pixels arranged in rows and columns, the method comprising:

generating all defined pixel drive signal levels;

providing each pixel drive signal level to an associated buffer;

storing values corresponding to required pixel drive signal levels for a row of pixels in a memory;

calculating a quantity of pixels of the row to be addressed by each drive signal, based on the stored values;

controlling the buffers by applying an appropriate bias current to each buffer in dependence on the calculated quantity of pixels; and switching the buffer outputs onto the columns during the row address period for the row to be addressed.

6. Column address circuitry for driving columns of a liquid crystal display, each column having a column output that is configured to provide one of a plurality of defined drive signal levels to a plurality of pixels, comprising:

circuitry for generating all of the defined drive signal levels on corresponding separate signal level lines, and a buffer associated with each signal level line, the outputs of the buffers being selectably switchable onto the column outputs, a memory storing values corresponding to the drive signal levels to be provided to each column, wherein each buffer each buffer has a plurality of selectable output stages, and the output stages selected is controlled in dependence on a quantity of columns to which the buffer output is to be switched.

7. The column address circuitry of claim 6, wherein the output of each buffer is selectively switched to each column output based on the stored value corresponding to the drive signal level to be provided to the column.

8. The column address circuitry of claim 6, wherein each column includes an N:1 selector that is configured to select the output of the buffer corresponding to the stored value corresponding to the drive signal level to be provided to the column, and N corresponding to a quantity of the defined drive signal levels.

9. The column address circuitry of claim 6, wherein the defined drive signal levels correspond to grey-scale illumination values.

* * * * *